US011313656B1

(12) United States Patent
Han

(10) Patent No.: US 11,313,656 B1
(45) Date of Patent: Apr. 26, 2022

(54) POP OUT WING UNIT

(71) Applicant: U.S. Government as Represented by the Secretary of the Army, Dover, NJ (US)

(72) Inventor: Seungeuk Han, Highland Park, NJ (US)

(73) Assignee: United States of America as Represented by the Secretary of the Army, Washington, DC (US)

( * ) Notice: Subject to any disclaimer, the term of this patent is extended or adjusted under 35 U.S.C. 154(b) by 282 days.

(21) Appl. No.: 16/776,781

(22) Filed: Jan. 30, 2020

(51) Int. Cl.
*F42B 10/14* (2006.01)

(52) U.S. Cl.
CPC ..... *F42B 10/14* (2013.01)

(58) Field of Classification Search
CPC ..... F42B 10/06; F42B 10/14; F42B 10/20; B64C 5/06; B64C 5/10; B64C 5/12
See application file for complete search history.

(56) References Cited

U.S. PATENT DOCUMENTS

| | | | | |
|---|---|---|---|---|
| 8,569,670 | B1 * | 10/2013 | Carlucci | F42B 10/20 244/3.28 |
| 11,168,959 | B2 * | 11/2021 | Frey, Jr | F42B 10/60 |
| 2013/0092790 | A1 * | 4/2013 | Geswender | F42B 10/14 244/63 |
| 2014/0312160 | A1 * | 10/2014 | Blake | F41G 7/00 244/3.1 |
| 2021/0055085 | A1 * | 2/2021 | Snavely | F42B 10/14 |
| 2021/0063127 | A1 * | 3/2021 | Cleveland | F42B 10/14 |
| 2021/0140748 | A1 * | 5/2021 | Buttolph | F42B 10/14 |

* cited by examiner

*Primary Examiner* — Benjamin P Lee
(74) *Attorney, Agent, or Firm* — John P. DiScala

(57) ABSTRACT

A fin deployment mechanism for a projectile to release the fins laterally or radially. This pop-out type of mechanism therefore avoids need for a sabot for projectile launching purposes. By avoiding the weight and space usage of a sabot, there can be increased length and volume for the warhead and projectile, at the same weight burden.

4 Claims, 13 Drawing Sheets

POP OUT WING UNIT

U.S. GOVERNMENT INTEREST

The inventions described herein may be made, used, or licensed by or for the U.S. Government for U.S. Government purposes.

BACKGROUND OF INVENTION

The invention, among other features, reduces the space needed to store fins on a projectile. Such modification would therefore allow for greater length, diameter and/or volume of a given warhead and projectile, for the same weight burden thereof. Some projectiles have jack knife type outside fins or fixed fins on the projectile body. A jack knife or fixed fin type of sub-caliber projectile requires the addition of a sabot for launching; this entails added weight and space usage there for.

BRIEF SUMMARY OF INVENTION

This invention instead utilizes a radial or lateral 'pop-out' type of fin deployment mechanism that does not require a sabot for launching purposes. By avoiding the weight and space usage of a sabot, for the same weight to be propelled, the net volume, diameter and/or length of the projectile could be increased. This means that there could be more volume for the warhead at the same weight burden. In this invention, fin deployment (including wings or canard) is lateral (or radial) with reference to the axis of rotation of the projectile (the longitudinal axis).

OBJECTS OF THE INVENTION

Accordingly, it is an object of the present invention to provide for a projectile, a radial or lateral pop-out type of fin deployment mechanism that does not require a sabot for projectile launching purposes.

Another object of the present invention is to eliminate the need for a sabot to launch a projectile having fins, which will provide more volume for the warhead and projectile at the same weight burden.

It is a further object of the present invention to improve launching of a jack knife or fixed fin type of sub-caliber projectile by not requiring the addition of a sabot for launching, instead using lateral or radial fin deployment to reduce weight and space usage there for.

It is yet another object of the present invention to launch a projectile while avoiding the weight and space usage of a sabot, whereby for the same weight to be propelled, the net volume, diameter and or length of the projectile could be increased.

These and other objects, features and advantages of the invention will become more apparent in view of the within detailed descriptions of the invention, the claims, and in light of the following drawings and/or tables wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

Figure 5:
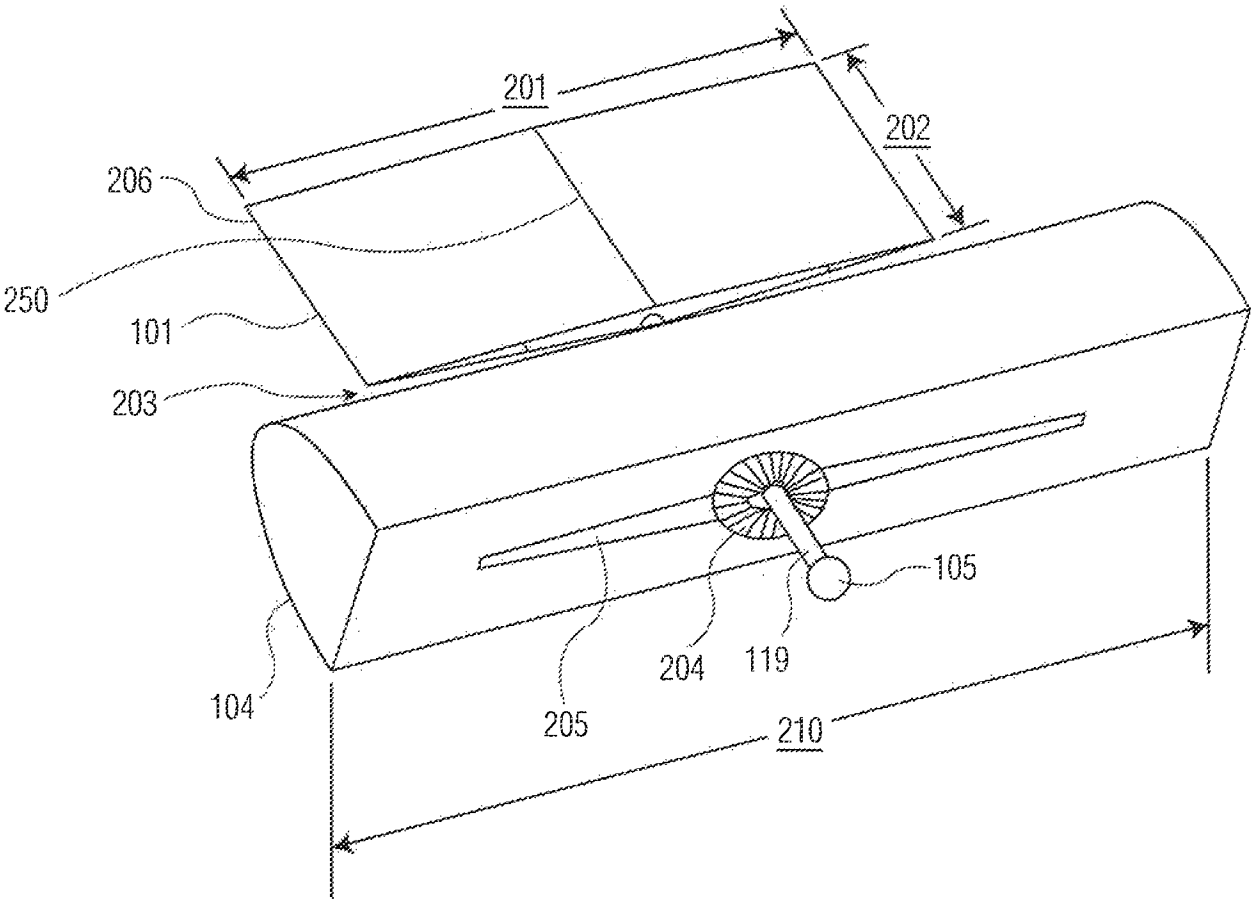

FIG. 5 shows a view of a fin 101 which had been completely deployed through its companion rotating cup 104, and leaving a space 203 below the fin, in accordance with this invention.

Figure 6:
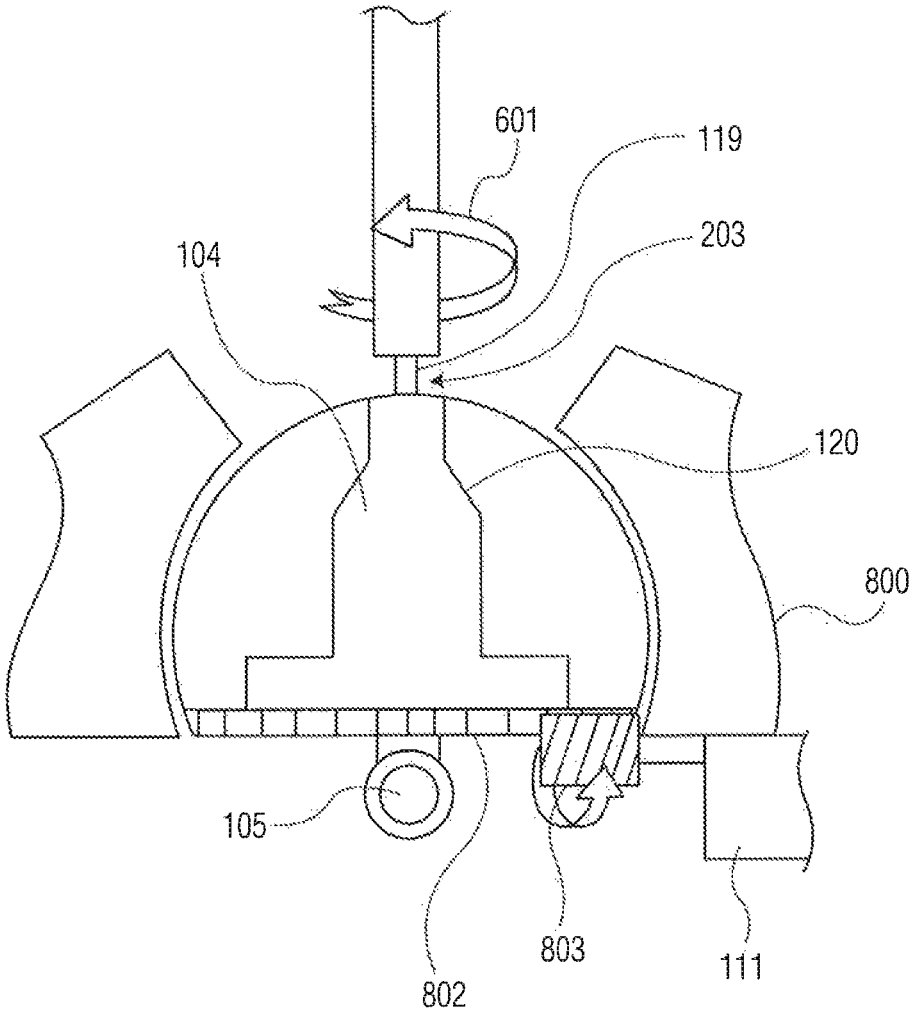

FIG. 6 shows a cut away view of the fin in its rotating cup, mounted in the system housing 800.

Figure 7:
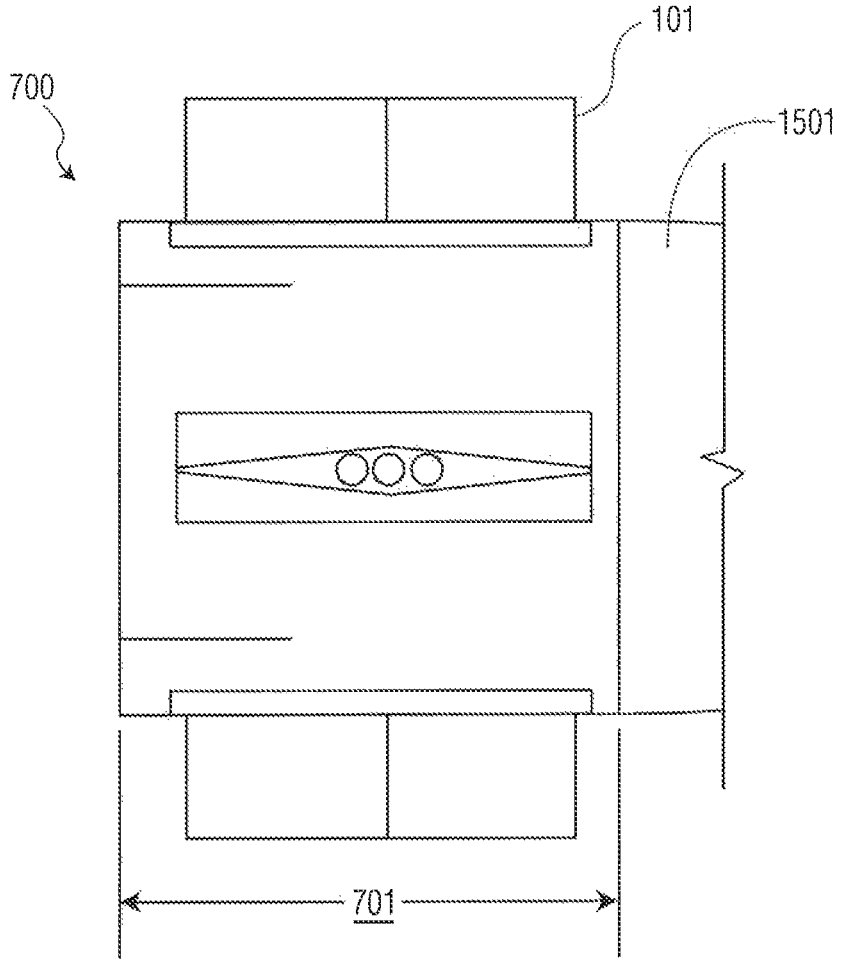

FIG. 7 shows a compact aft unit 700 which holds the 'pop up' wing deployment mechanism, and which shows deployment of several of the fins, according to this invention.

Figure 8:
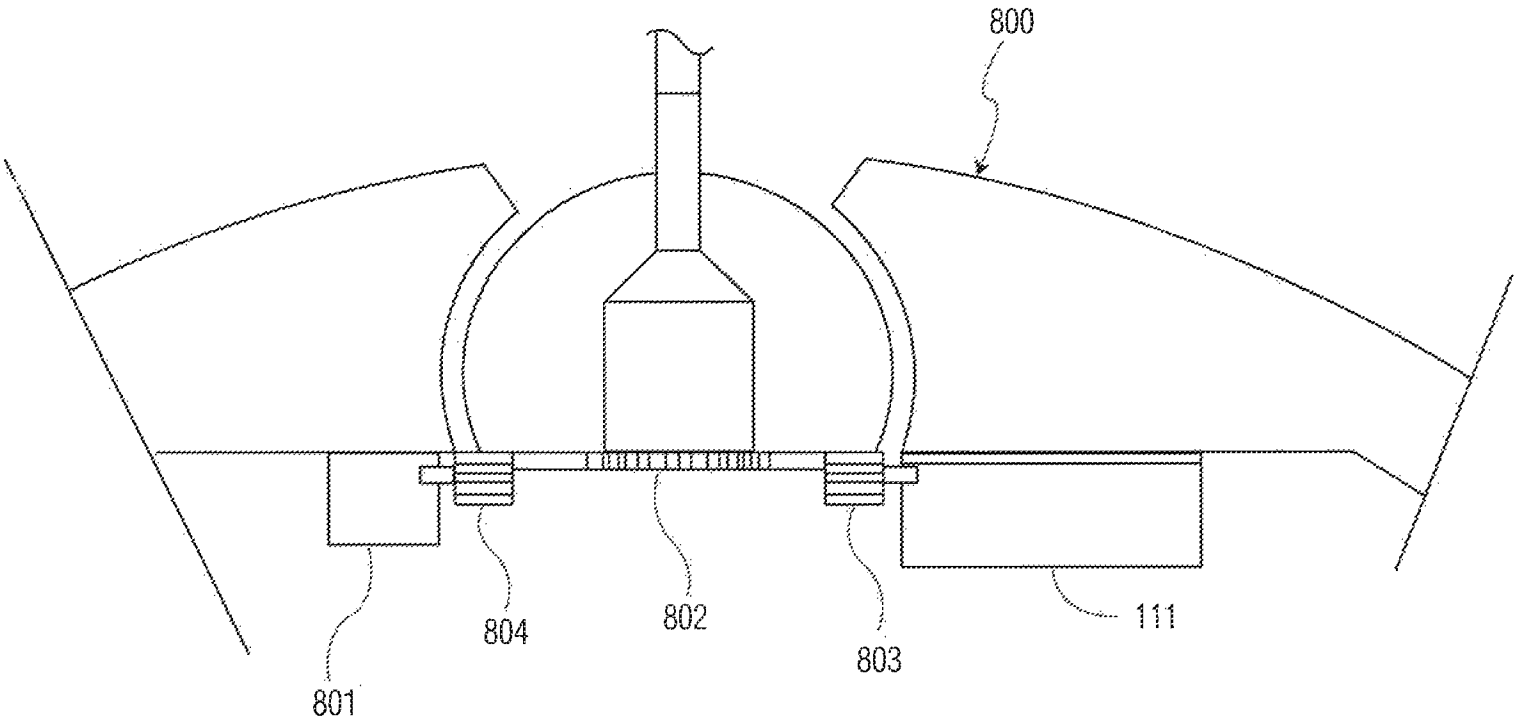

FIG. 8 shows another cut away view of the fin in its rotating cup, mounted in the system housing 800, and illustrates where the fin may be controlled by gearing 802, 803 and 804 and motor 111 for rotation.

Figure 9A:
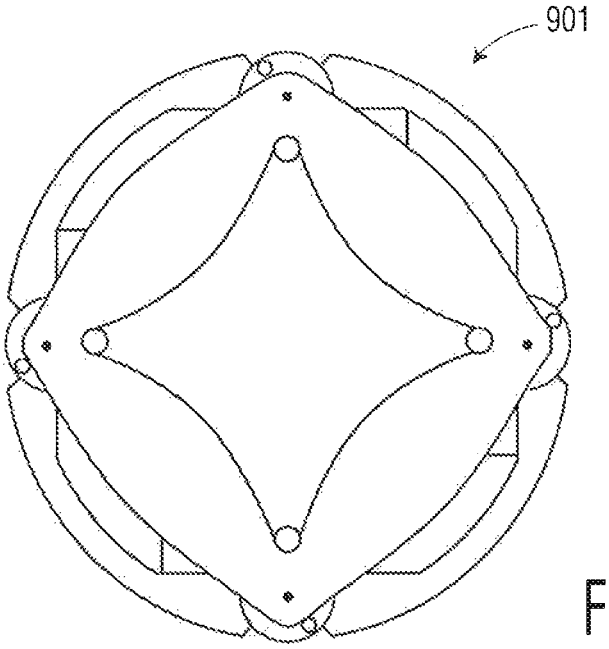

FIG. 9A shows an outer leaf 901 which aids in deploying the fins during rotation of the clock mechanisms 109.

Figure 9B:
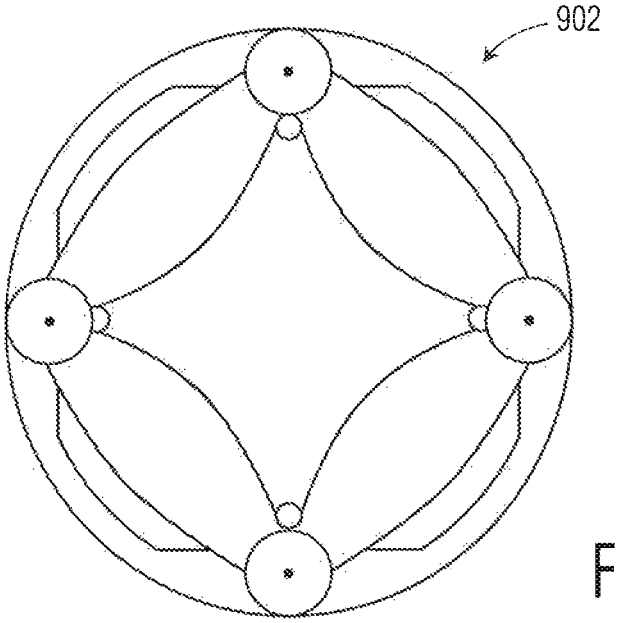

FIG. 9B shows a distal outer leaf 902 which also aids in deploying the fins during rotation of the clock mechanisms 109.

Figure 9C:
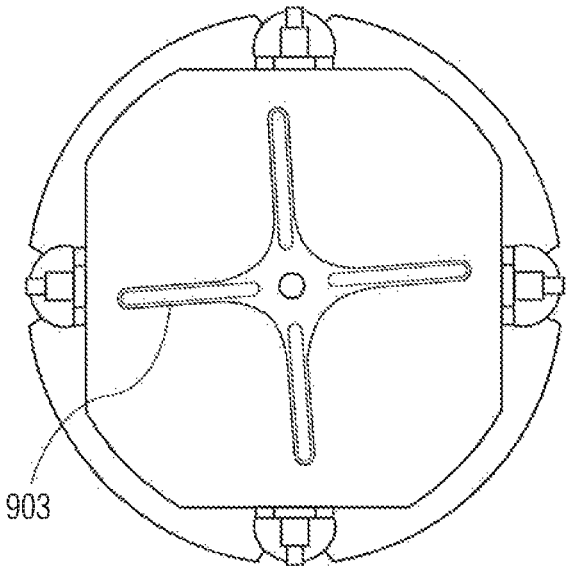

FIG. 9C shows a rail 903 which also aids in deploying the fins during rotation of the clock mechanisms 109.

Figure 10:
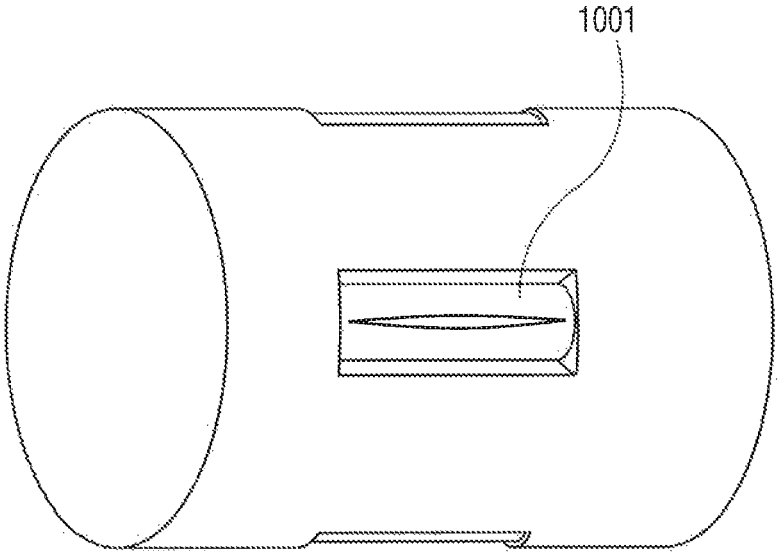

FIG. 10 shows the compact aft unit 700 of this system as a modular unit with outer areas 1001 of the fin slots being shown, and through which deployment of fins may occur.

Figure 11:
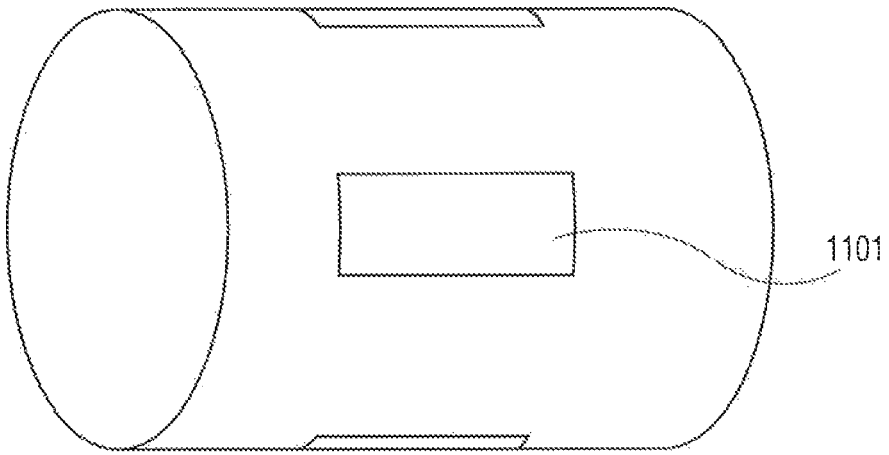

FIG. 11 shows the compact aft unit 700 of this system as a modular unit where the fin slots are covered with plugs 1101 when not being used for fin deployment.

Figure 12:
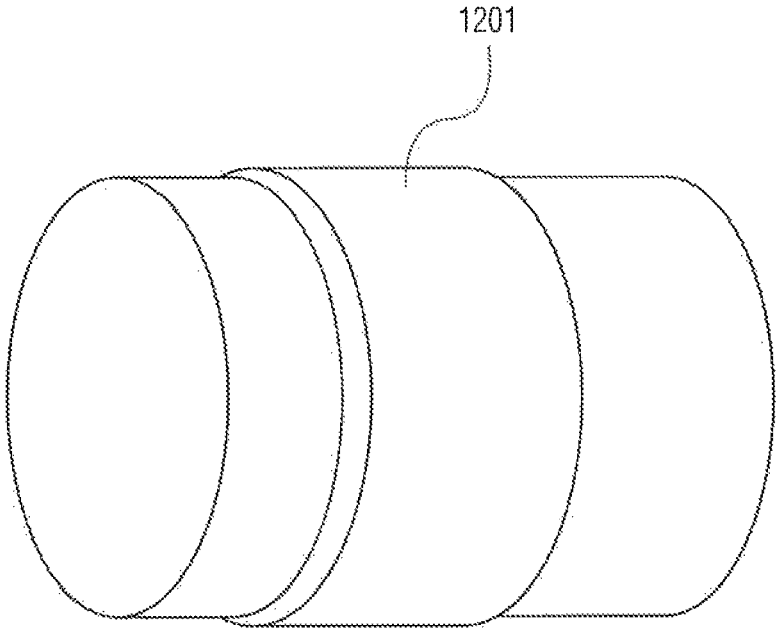

FIG. 12 shows the compact aft unit 700 of this system as a modular unit where the fin slots are instead covered by an obturator ring 1201; the obturator ring may be used for launching a round to which the modular cavity is an integral part.

Figure 13:
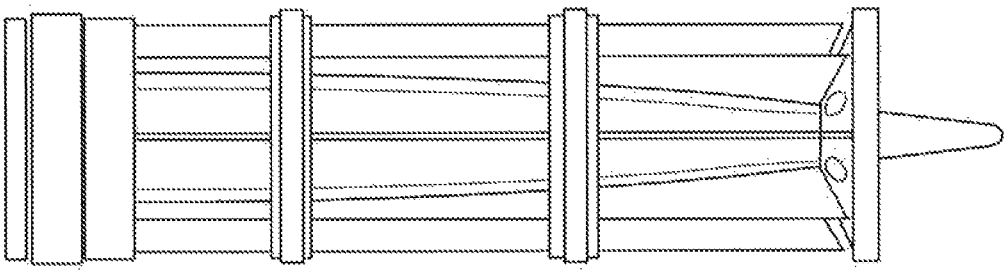

FIG. 13 shows a previous method of launching a payload projectile with wings, where jack knife type fin mechanisms are held in place during launch, but spring out during later flight.

Figure 14:
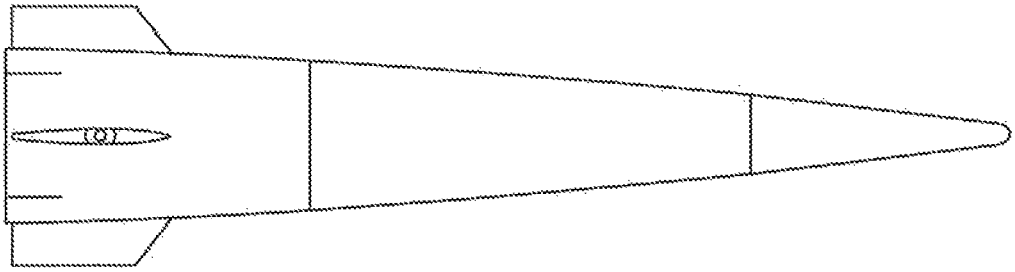

FIG. 14 illustrates the size of a projectile which may be launched by the previous method shown by FIG. 13.

Figure 15:
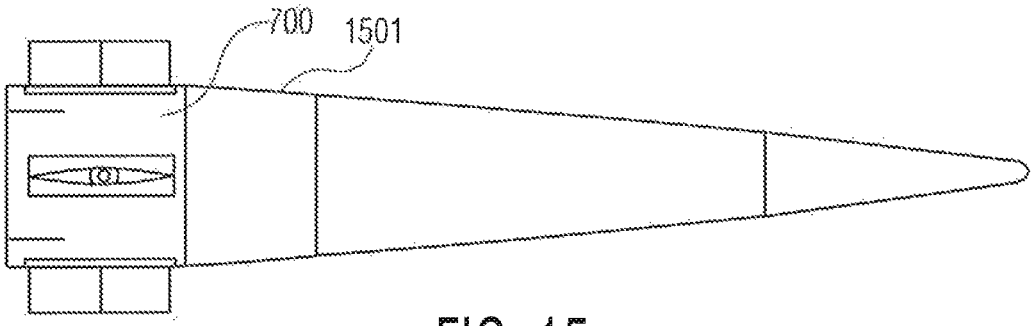

FIG. 15 shows a payload launched on a projectile with a compact aft unit 700 according to this invention attached as a modular unit, which tends to be a larger volume than that of FIGS. 13 and 14.

Figure 16:
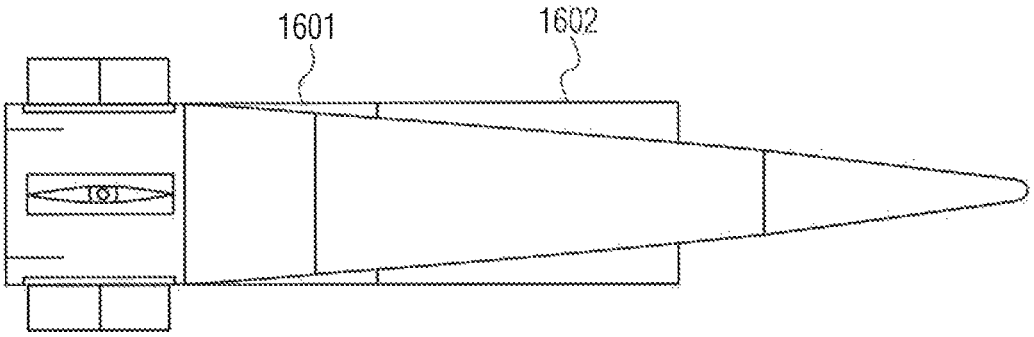

FIG. 16 shows a payload launched on a projectile as in FIG. 15 with a compact aft unit 700 according to this invention attached as a modular unit, but with sabot or bore rider points 1601 added onto the projectile.

Figure 17:
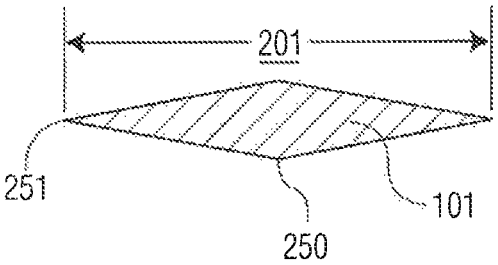

FIG. 17 shows the cross sectional shape of a fin 101 which may be essentially diamond shaped, sized to snugly fit into, and for the fin to be able to be pushed through, a fin slot 205.

DETAILED DESCRIPTION

Figure 1:
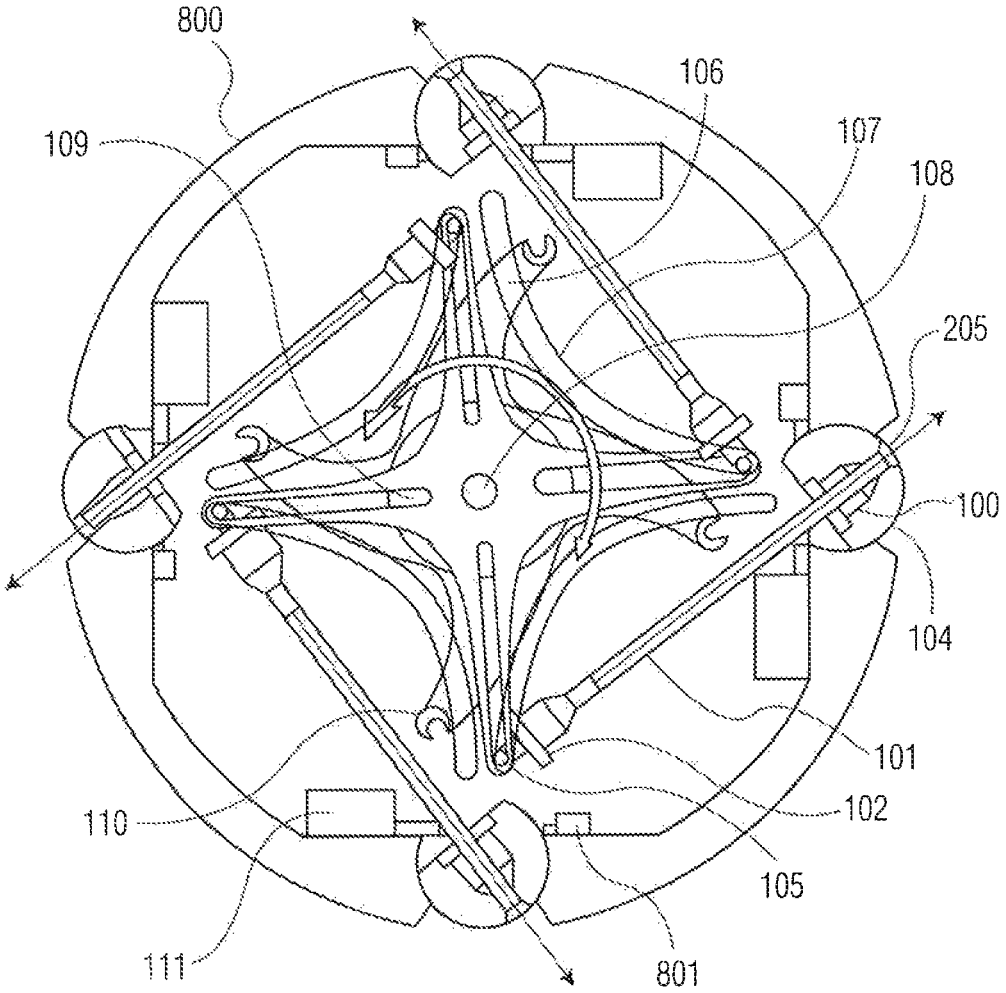
FIG. 1 illustrates a cross section of four fins 101 (edge view) shown pre-stacked within a pop out compact aft unit 700 of this system, in accordance with this invention.
Figure 2:
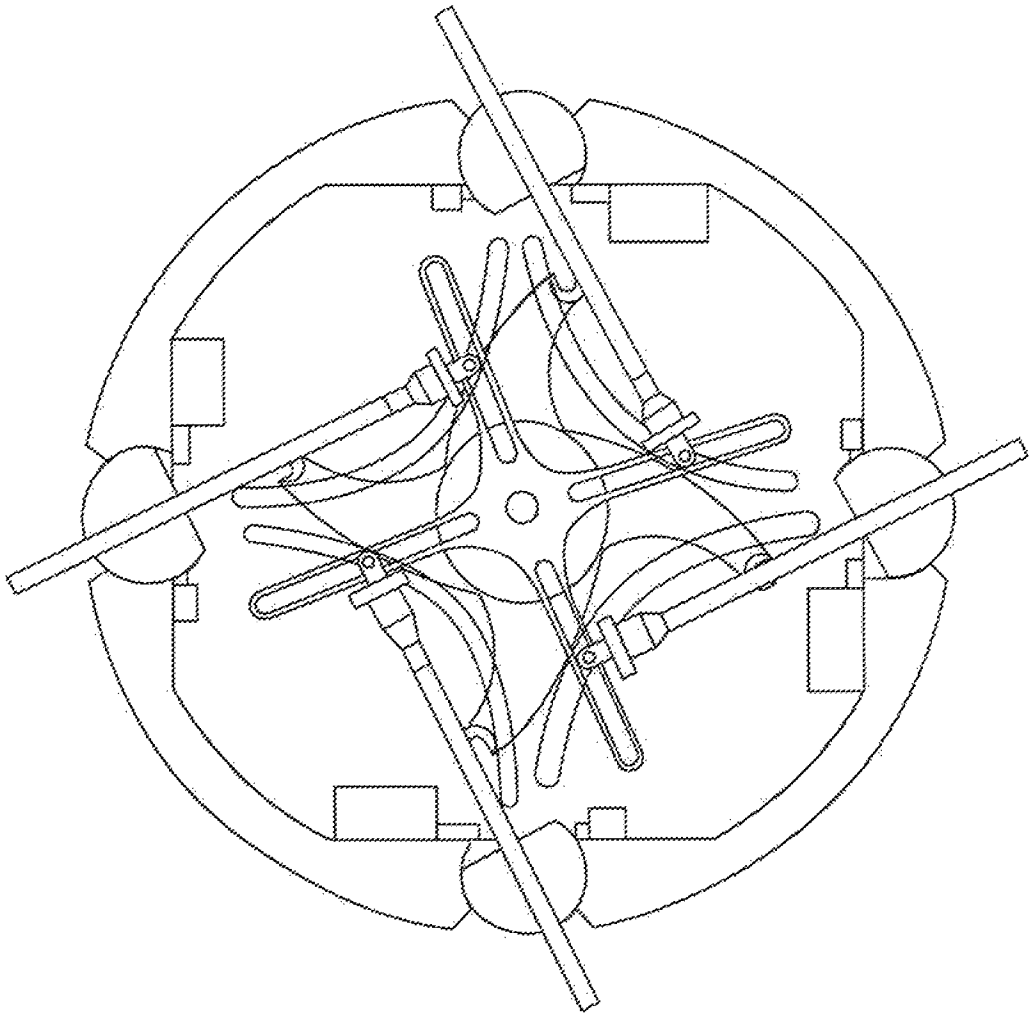
FIG. 2 shows the cross section of FIG. 1 where the fins have been partially extended through the rotating cups 104 by turning of clocking mechanisms 109.
Figure 3:
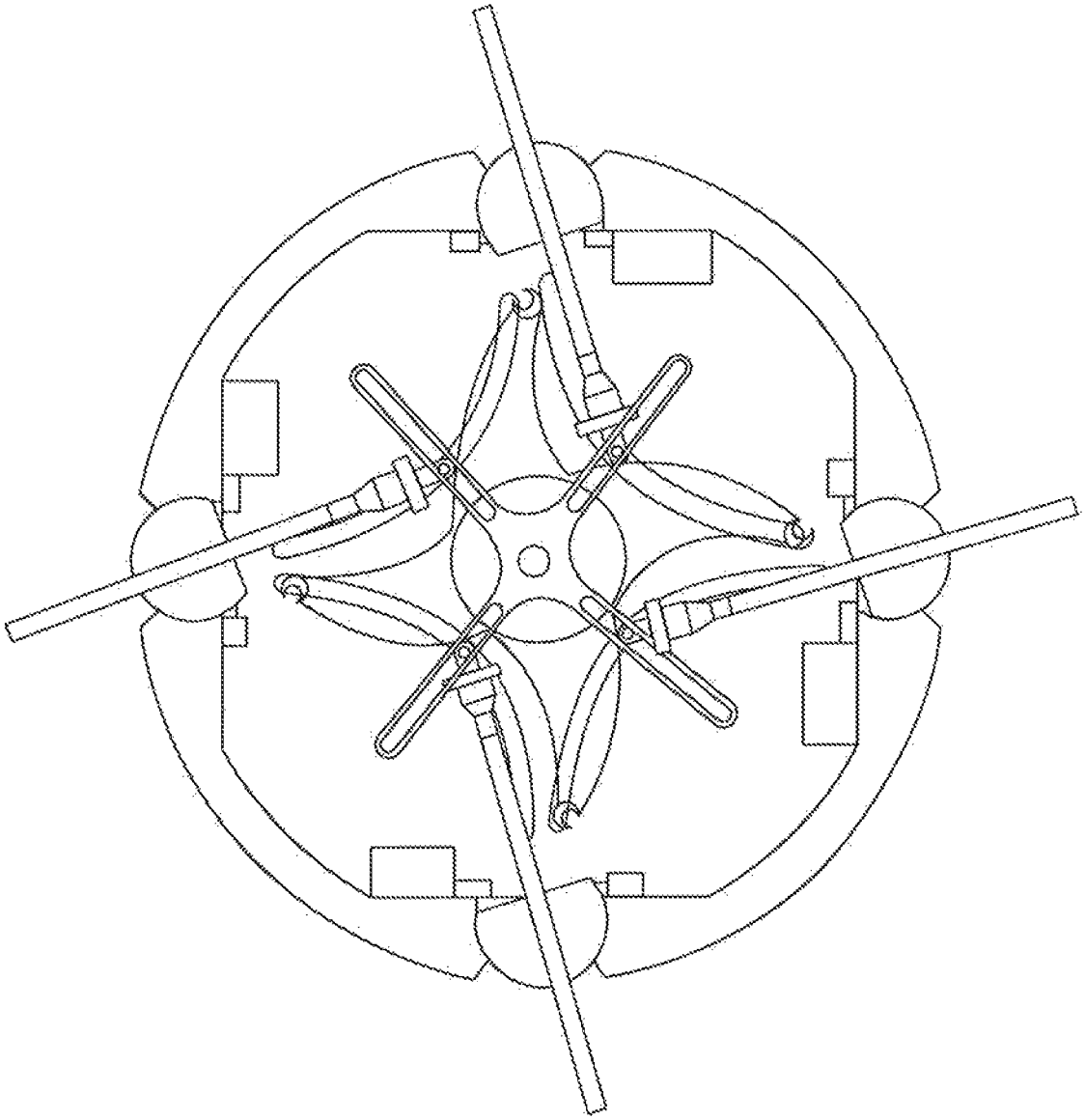
FIG. 3 shows the cross section of FIG. 1 where the fins have yet further extended through the rotating cups 104 by turning of clocking mechanisms 109.
Figure 4:
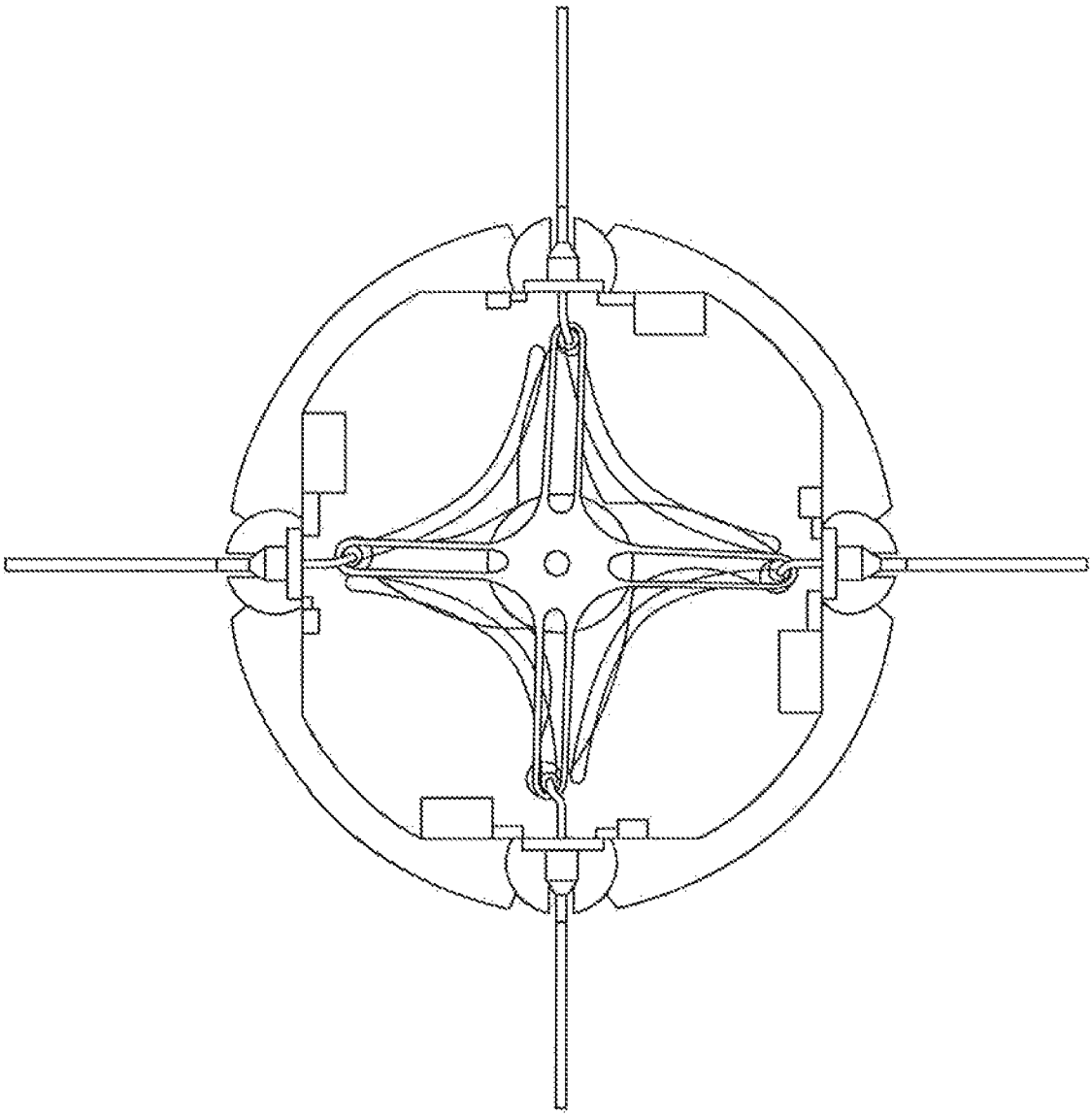
FIG. 4 shows the cross section of FIGS. 1-2 where the fins have been fully extended and deployed through the rotating cups 104 by turning of clocking mechanisms 109.

The invention is discussed with reference to the FIGS. 1-17, as follows. In FIG. 5, a fin 101 is depicted; it has overall length 201, width 202, and an edge represented by number 206. Its cross sectional shape may be diamond shaped as shown in FIG. 17. Fin 201 is shown positioned in rotating cup 104 (having length 210) and having a fin slot 205 through which fin 101 will be pushed, to a distance where a space 203 will exist between the rotating cup 104 and the fin 101 to clear the rotating cup. As will be described with respect to FIG. 6, the fin may be turned on a center axis 119 that includes fin joint 105, because of this clearance space 203. A gear 204 on this center axis, enables this turning by actions of a motor means (such as 111) and gearing 802, 803 and 804. In cross sectional view FIG. 1, four fins (each one such as 101 in edge view essentially) are shown stacked within these inner working regions of compact aft unit 700 (of FIG. 7), within hollow body frame 800. To be noted, compact aft unit 700 has a length 701 which exceeds the length 201 of any fin and which also exceeds the length 210 of any of the (four) rotating cups 104, In FIG. 7, compact aft unit 700 is attached at the aft end of a projectile such as 1501. In FIG. 1, each fin 101 is pre-inserted partially through fin slot 205 of its partnered rotating cup 104, as a starting position. A gear like clocking mechanism 109 turns counter clockwise on a central axis 108, with the aid of a deploying motor device (not shown here). As will be seen, the fins are nudged forward by the counter clockwise turning motion of arms 106 of mechanism 109, along stenciled tracks such as 107 as a pathway. Each arm also has a hook device 110 for initially capping elements 105 on fin end caps 102. There is one rotating cup motor means 111 adjacent each rotating cup 104, inside this compact aft unit 700. As shown by progressive steps in FIGS. 1-4, the fins are nudged forward by the counter clockwise turning motion of arms 106 of mechanism 109, until in FIG. 4 they are fully extended out of compact aft unit 700, each having fully been pushed through the fin slot 205 of their matching rotating cup 104. As was mentioned, there is a space 203 beneath each fully extended fin, making rotation 601 of a fin eventually possible, during flight. There are two such mechanisms 109, each positioned within an opposite end of cavity 200 to hold the fins in place, and mounted on central axis 108; there is also a centered rotatable rail device 903 (FIG. 9C) on the central axis 108 to further aid in holding the fins in place before they are fully extended out of the compact aft unit 700. There are also two leafs 901 (FIG. 9A) and 902 (FIG. 9B) serving as outer end caps over the mechanisms 109. In FIG. 8, a cross section is shown of fin in place in (each) rotating cup, sectioned inside the overall housing frame 800, also showing rotating cup motor means 111, stopper, and gearing 802, 803, 804 and stopper device 801. In FIG. 10, the fin mounting cavity is shown as a modular unit with outer areas 1001 of the fin slots being shown, and through which deployment of fins may occur. FIG. 11 shows the modular cavity where the fin slots are covered with plugs 1101 when not being used for fin deployment. FIG. 12 shows the modular cavity where the fin slots are instead covered by an obturator ring 1201; the obturator ring may be used for launching a round to which the modular cavity is an integral part. It serves to contain gases in a launch tube, during a firing. FIG. 13 shows an older method of launching where jack knife type fin mechanisms are held in place during launch, but spring out during later flight. However, this consumes great amount of space leading a smaller volume of a projectile possible for the given weight which can be launched. This invention by contrast, utilizes far less space for the compact aft unit 700 mechanism. Therefore a larger projectile volume is achievable for the same weight carriage with the compact aft unit 700 mechanisms of this invention, as illustrated by the example of projectile 1501 in FIG. 15. FIG. 16 shows this example of FIG. 15, but with sabot or bore rider points 1601 and 1602 added. FIG. 17 shows the cross sectional shape of a fin 101 which may be essentially diamond shaped, sized to snugly fit in and for the fin to be able to be pushed through a fin slot 205. However, the cross sectional shape may be rectangular or some other shape, so long as it can deploy through the fin slot 205.

The following further comments are offered in regard to the operation of the invention. By rotating the rail 903 designed to follow the slot on the leafs 901, 902 (the pre-designed disk), which is supported by the arm 106 of the clocking mechanism 109 (which also rotates along the rail), the fins 101 slide out through the slot 205 on the rotating cup 104. When the fin 101 is fully pushed out and the fin cup 100 is fully inserted in the fin shoulder 120, the fin shoulder is fully engaged in the shoulder slot on the rotating cup 104. The center axis 119 has a gear disk 802 which is automatically engaged with the gear of the motor 111; hence, the motor may rotate the center axis 119. The center axis 119 is connected to the fin 101 and the fin is rotating along with it. Deployment of the fins are accomplished by a rail 903 directly connected to each fin 101 (the fins slide freely along the rail), the arms that push the rod connected to the fins sliding along the rail, and the leaf stenciled arc so the rod connected to the fins can be constrained in its motion along the stenciled arc. These are mirrored on the other side for firm and stable support. The rotating cup 104 freely rotates depending on the fin's directional motion. When the fin shoulder 120 is fully inserted in the rotating cup 104, then the flat surface of the cup is flushed to the projectile inner wall. And the gear 802 on the fin then is engaged by the gear of motor 111. The gear and the motor control the attack angle of the fin.

A fin joint lock 105 on the arm 119 also locks the fin creating an additional security for fin deployment when the fin shoulder is fully inserted in the rotating cup. A fin joint for lock 105 creates a ball joint with the rod, to ensure fin rotational freedom. The leaf 901, 902 has a pre-cut arc acting as a rail for the rod 119 supporting the fin joint 105 to stay on the track. This arc angle is important to minimize the angular motion of the rotating cup 104, which affects the opening (fin slot) of the compact aft unit 701 body. The rod is inside the rail to constrain its position. The arm pushes the rod supporting the fin joint to stay in an outward position in the rail, to extend the fins out of the rotating cup. Once the fin is fully pushed out, the joint is locked on the arm lock to secure the position and the shoulder 120 is fully engaged with the shoulder slot 205. When the shoulder is in position, the rotating cup 105 is stopped by and engaged with the gear connected to the motor 111, which drives the motion. When the shoulder is in position, the lock pushed by the rotating cup is released and automatically blocks the rotating cup from rotating backwards (it locks the rotating cup). When the shoulder is in position, the fin connected to the fin joint is fully out of the projectile body and is freely in the air stream. When the rotating cup 104 is locked, and therefore the fins are in free stream, the motor 111 can drive the shoulder to rotate the fins upon command.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A compact aft unit (700) for a projectile, said aft unit for selectively deploying fins (101), said aft unit comprising a hollow body frame (800), and four rotating cups (104) mounted equidistantly around the circumference of said frame, and;

at each rotating cup location, inside said frame, there is mounted a motor (111) and a stopper (801), and gearing (802, 803, 804), and;

each rotating cup (104) has a fin slot (205) which has thereon a fin shoulder (100), and each fin (101) has a fin cup (120) sized to mate with said fin shoulder (100), a lower central axis (119) which supports said fin cup (120) and which leads to a distally attached fin joint (105), and which fin joint is functionally turnable by said gearing (802, 803, 804) and motor (111), and;

further within said hollow body frame (800) there are two gear like clocking mechanisms (109) which are synchronously turnable, counter clockwise looking from an aft end of the compact aft unit (700), on a central axis (108) and said clocking mechanisms (109) each having thereon four arms (106) with each arm also having distally thereon a hook device (110) for initially capping an edge of a fin (101), and also wherein each fin (101) is pre-inserted partially through fin slot (205) of its partnered rotating cup (104) as a starting position, and; as the gear like clocking mechanisms (109) turn, the fins are nudged forward into their respective fin slots (205) by the counter clockwise turning motion of the arms (106) of the mechanisms (109), along stenciled tracks (107) as a pathway, until they are fully extended out of the compact aft unit (700), each having fully been pushed through the fin slot (205) until fin cups (120) are stopped in fin shoulders (100) of their matching rotating cup (104), and also leaving a space (203) beneath each fully extended fin, and;

whereas there is also a centered rotatable rail device (903) on the central axis (108) within the compact aft unit (700) to further aid in holding the fins before they become fully extended out of the compact aft unit (700), and;

whereas, there are also two leafs (901) and (902) serving as outer end caps of cavity compact aft unit (700), covering over the mechanisms (109) there within, and;

whereas the fins are flight rotatable (601) above space (203) through the lower central axis (119) thereon by said gearing (802, 803, 804) and motor (111), and whereas each fin (101) has a length wise cross sectional shape which is diamond shaped and sized for the fin to fully fit through its fin slot (205), and wherein the widest part of a fin is along a vertical center line (250).

2. The compact aft unit (700) of claim 1, wherein outside areas (1001) of the fin slots are covered with an obturator (1201).

3. The compact aft unit (700) of claim 1, wherein outside areas (1001) of the fin slots are covered with an obturator (1201).

4. The compact aft unit (700) of claim 1 attached to a projectile, and wherein the projectile has thereon, sabot or bore rider points (1601, 1602).

* * * * *